US010576347B2

(12) United States Patent
Rajamäe-Parik et al.

(10) Patent No.: US 10,576,347 B2
(45) Date of Patent: Mar. 3, 2020

(54) BATH FOR EXERCISING

(71) Applicants: Heidi Rajamäe-Parik, Keila (EE); Meelis Unt, Tallinn (EE); Tarmo Härmaorg, Tallinn (EE)

(72) Inventors: Heidi Rajamäe-Parik, Keila (EE); Meelis Unt, Tallinn (EE); Tarmo Härmaorg, Tallinn (EE)

(73) Assignee: OU Waterflight, Keila (EE)

( * ) Notice: Subject to any disclaimer, the term of this patent is extended or adjusted under 35 U.S.C. 154(b) by 0 days.

(21) Appl. No.: 15/318,232

(22) PCT Filed: Jun. 12, 2015

(86) PCT No.: PCT/IB2015/054469

§ 371 (c)(1),
(2) Date: Dec. 12, 2016

(87) PCT Pub. No.: WO2015/189822

PCT Pub. Date: Dec. 17, 2015

(65) Prior Publication Data

US 2017/0120129 A1 May 4, 2017

(30) Foreign Application Priority Data

Jun. 12, 2014 (EE) ..... 201400044 U

(51) Int. Cl.
*A63B 69/12* (2006.01)
*A63B 21/008* (2006.01)
(Continued)

(52) U.S. Cl.
CPC ..... *A63B 69/12* (2013.01); *A63B 21/0084* (2013.01); *A63B 21/4037* (2015.10);
(Continued)

(58) Field of Classification Search
CPC ..... A63B 21/4039; A63B 21/0084; A63B 23/1272; A63B 23/0488; A63B 2208/03;
(Continued)

(56) References Cited

U.S. PATENT DOCUMENTS 3,421,162 A * 1/1969 Greenberg ..... E04H 4/0037 4/513
3,518,705 A * 7/1970 Cudney ..... E04H 4/0018 52/169.7
(Continued)

FOREIGN PATENT DOCUMENTS

DE 3313828 A1 * 10/1984 ..... A63B 69/12
EP 1719489 A1 11/2006
(Continued)

OTHER PUBLICATIONS

Translation for DE 3313828.*
(Continued)

*Primary Examiner* — Megan Anderson
(74) *Attorney, Agent, or Firm* — Maine Cernota & Rardin

(57) ABSTRACT

Bath for exercising, the bath containing substantially vertical wall portion, and a suitably configured bath bottom, from which extends an exercise base, wherein the bath bottom is formed so that the bath is the deepest in the area where the person lying on the exercise base reaches when moving her legs, the bath is lower in the area where she reaches when moving her arms, wherein the bath bottom is shaped so that in the top view it follows the trajectory of the user can reach when moving her limbs.

4 Claims, 3 Drawing Sheets

(51) Int. Cl.

| | |
|---|---|
| ***A63B 21/00*** | (2006.01) |
| ***A63B 23/04*** | (2006.01) |
| ***A63B 23/12*** | (2006.01) |
| *A61H 33/00* | (2006.01) |
| *A63B 22/06* | (2006.01) |

(52) U.S. Cl.
CPC ..... *A63B 21/4039* (2015.10); *A63B 23/0488* (2013.01); *A63B 23/1272* (2013.01); *A61H 33/0087* (2013.01); *A61H 2203/0456* (2013.01); *A63B 22/0605* (2013.01); *A63B 2208/0242* (2013.01); *A63B 2208/0252* (2013.01); *A63B 2208/03* (2013.01)

(58) Field of Classification Search
CPC .. A63B 2208/0252; A47K 3/006; A47K 3/02; A47K 3/022; A47K 3/12
See application file for complete search history.

(56) References Cited

U.S. PATENT DOCUMENTS

| | | | | | |
|---|---|---|---|---|---|
| 5,554,091 | A | | 9/1996 | Patey | |
| 5,819,333 | A | * | 10/1998 | Coleman | A47K 3/06 4/538 |
| D612,023 | S | * | 3/2010 | Harris | D23/278 |
| 7,699,760 | B2 | * | 4/2010 | Hruska, Jr. | A63B 21/0084 4/541.3 |
| 8,057,369 | B1 | | 11/2011 | Salach | |
| D753,276 | S | * | 4/2016 | Rajamae-Parik | D23/278 |
| 2014/0230139 | A1 | * | 8/2014 | Jin | A47K 3/122 4/578.1 |

FOREIGN PATENT DOCUMENTS

| | | | |
|---|---|---|---|
| FR | 2395749 | A1 | 1/1979 |
| FR | 2581540 | A1 | 11/1986 |
| WO | 2013001264 | A1 | 1/2013 |

OTHER PUBLICATIONS

Website: https://www.theverticalpool.com/index.html archived: Apr. 7, 2011 retrieved: Jan. 22, 2018 (Year: 2011).*
International Search Report of International Application No. PCT/IB2015/054469, dated Oct. 12, 2015, 3 pages.

* cited by examiner

A-A

D-D

B-B

C-C

BATH FOR EXERCISING

RELATED APPLICATIONS

This application is a National Phase application of PCT Application No. PCT/IB2015/054469 filed on Jun. 12, 2015, which claims priority from Estonian Application No. U201400044 filed Jun. 12, 2014. Each of these applications is herein incorporated by reference in their entirety for all purposes.

TECHNICAL FIELD

This invention pertains to pools and baths involving the entire body, in particular to baths that allow relaxing, therapeutic and sport exercises to be performed in water in a supine position.

BACKGROUND ART

Estonian patent EE05640 "Device for exercising in a horizontal position" with publication date 15 Jun. 2011, is known. It constitutes a base following the shape of a human body for exercising in a supine position, wherein pursuant to one realisation sample the base is placed in a suitable vessel filled with water in a way that permits the person to do suitable exercises from a lying position on the waterline.

This can be considered the closest solution from the point of view of background art. The disadvantage of such a solution is the availability of a suitable vessel, the need to secure the base safely to the vessel and in addition the significant quantity of water required to fill the vessel.

The aim of the invention is to eliminate these and other technical problems.

DISCLOSURE OF INVENTION

The objective of the invention is achieved with a bath, containing a substantially vertical wall portion, and a suitably configured (shaped) bottom, from which extends an exercise base, which is preferably manufactured so as to be integrated with the bath bottom, and the bath bottom is formed (shaped) so that the bath is deepest in the area where the person lying on the exercise base reaches when moving their legs ("leg area"), the bath is lower in the area where they reach when moving their arms ("arm area"), wherein close to the hips of the person lying on the base, the base is slightly inclined towards the leg area, and in the elbow area there is a deeper area in the bath bottom in order to avoid hitting sensitive body parts or exposing the latter to unnecessary pressure. The shape of the bath viewed from the top is preferably configured (shaped) so that it follows the trajectory the user of the exercise base reaches when moving their limbs. Viewed from the top, the bath bottom shall preferably resemble a "snow angle" (i.e. a figure formed when a person lying on their back on the snow moves their hands from their side over their head and legs apart and together). The exercise base is preferably provided with an adjustable back support, which can be raised and lowered to ensure that the depth of water is appropriate for people of different heights to do the exercises. Adjusting of the back support is simpler and saves more water compared to increasing or decreasing the water level.

EXAMPLES

Figure 1:
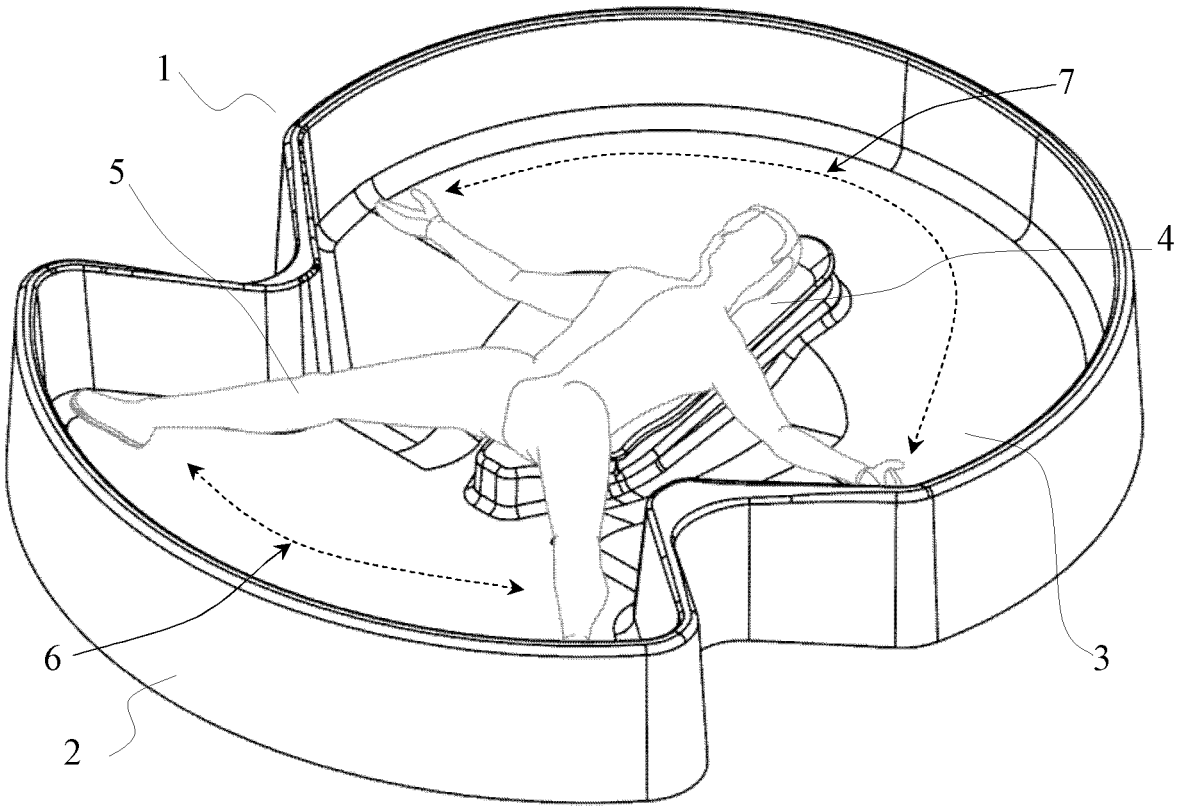
FIG. 1 shows a general view of the bath.
Figure 2:
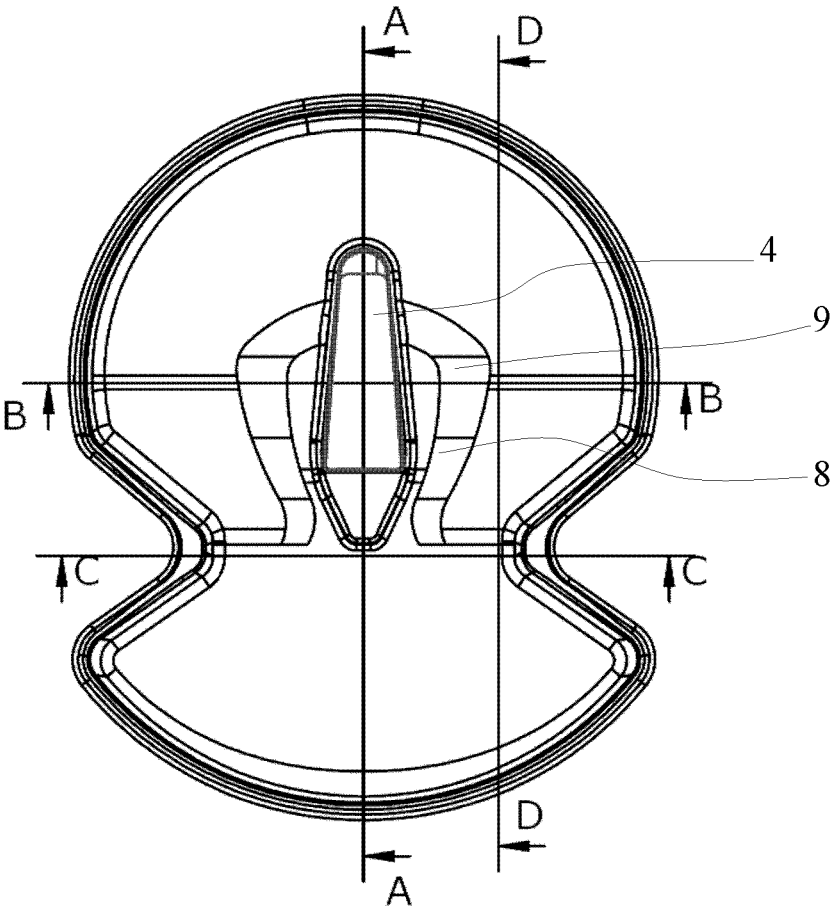
FIG. 2 shows a top view of the bath.
Figure 3:
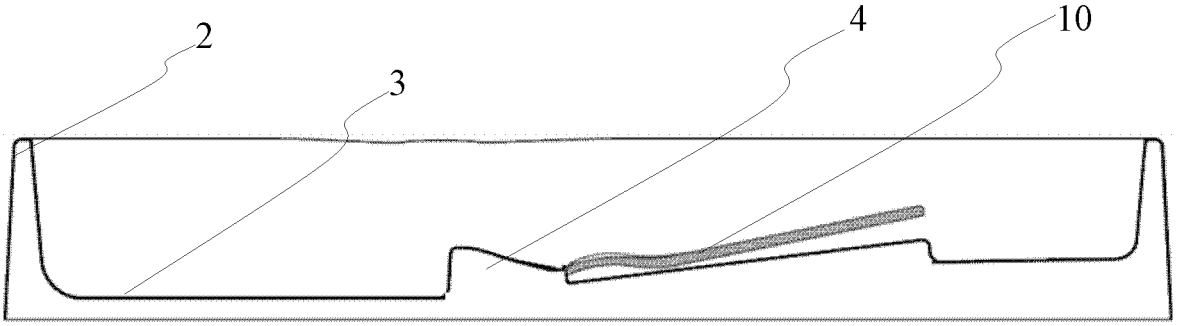
FIG. 3 shows section A-A along the axis of symmetry of the bath.
Figure 4:
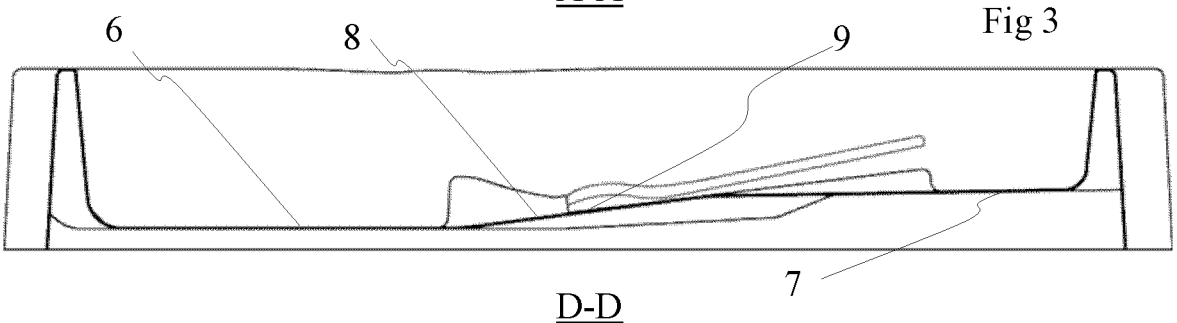
FIG. 4 shows section D-D along the straight line parallel to the axis of symmetry of the bath.
Figure 5:
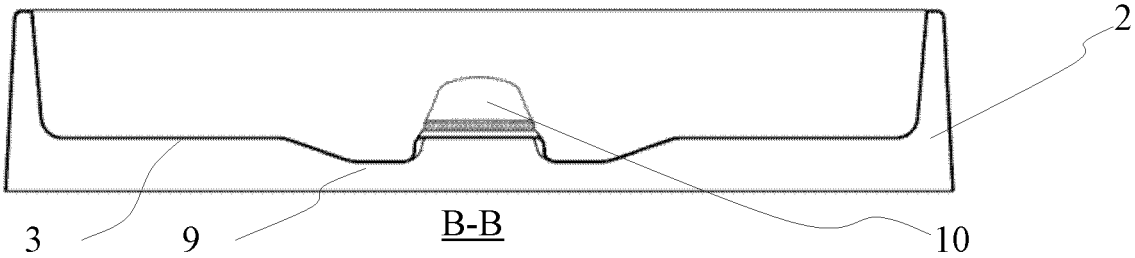
FIG. 5 shows section B-B.
Figure 6:
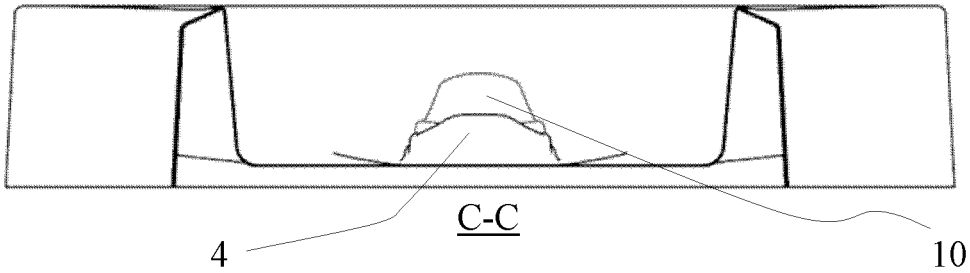
FIG. 6 shows section C-C.

FIG. 1 through FIG. 6 shows one example of how the invention can be realised. A bath 1 according to the invention for exercising comprises a substantially vertical wall portion 2 and a suitably configured bath bottom 3, from which extends an exercise base 4, which is comfortable for the bath user 5 to lie on and/or do relevant exercises. In order to reduce the water quantity used in the bath, the exercise base is preferably made so that it is integrated with the bath bottom (in one piece). In order to use the bath, it is filled with water in such a quantity that a person lying on the exercise base is close to the waterline, whereas to reduce the water quantity needed to exercise the bath base is shaped so that the deepest area of the bath is in the area 6 the person lying on the exercise base reaches when moving their legs and lowest in the area 7 they reach when moving their arms (the movement range of the limbs is conditionally marked with dotted arrows). Approximately in the area by the hips of the person lying on the exercise base, the bath bottom near the exercise base is slightly inclined towards the leg area (marked with 8) and in the area of the elbows the bath is deeper (marked with 9) to avoid hitting elbows as sensitive body parts or exposing the latter to unnecessary pressure. The back support 10 of the exercise base 4 can be preferably lowered and raised, in order to ensure a suitable depth of water for people of different heights. Adjusting the back support is simpler and saves more water compared to increasing or decreasing the water level. A water level which is as low as possible enables the body to remain in place on the sitting base of the exercise base and back support (water uplift force is exceeded), which is especially needed while moving the arms and legs. The head remains above the waterline to ensure that the respiratory tract and ears remain out of the water, whilst preserving a comfortable position of the neck. The contour of the bath bottom is shown in sections A-A through D-D (FIG. 3 through FIG. 6).

Also, the bath bottom (viewed from the top) is shaped on the basis of the range of movement of the arms and legs of a person lying on the exercise base and exercising, following the shape of a "snow angle". The vertical wall portion 2 follows the perimeter of the bath bottom.

The bath is made from a suitable material, among others suitable plastics (for instance glass-plastic), metal or wood.

The bath may be equipped with various accessories, for instance water inlets and outlets, different water and air massage devices, a water volume control device (including automatic control devices), water temperature control devices and other accessories enhancing user comfort and the user experience.

The invention claimed is:

1. A bath for exercising, comprising a vertical wall portion and a suitably shaped bath bottom from which extends an exercise base, wherein the suitably shaped bath bottom is shaped so that the bath is deepest in an area that is associated with a reach of a person's legs when the person is lying on the exercise base and shallowest in an area that is associated with a reach of the person's arms when the person is lying on the exercise base, wherein the exercise base is located in a middle of the suitably shaped bath bottom, wherein a shape of the bath as viewed from a top is configured so that it follows a trajectory determined by the reach of the person's legs and by the reach of the person's arms in a horizontal direction when the person's legs and the person's arms are fully extended when the person is lying on the exercise base.

2. The bath according to claim 1, wherein the exercise base is integrated with the bath bottom.

3. The bath according to claim 1, wherein in an area associated with hips of the person lying on the exercise base, the suitably shaped bath bottom is slightly inclined towards an area associated with the reach of the person's legs when the person lying on the exercise base, and in an area associated with elbows of the person lying on the exercise base there is a deeper area to avoid hitting the elbows of the person or exposing the elbows of the person to unnecessary pressure.

4. The bath according to claim 1, wherein the exercise base is provided with an adjustable back support for adjusting the person's position in respect with a water level so that the person's body is below the water level while person's respiratory tract and ears are above the water level when the person is lying on the exercise base.

* * * * *